US012031537B2

(12) United States Patent
Foerster et al.

(10) Patent No.: US 12,031,537 B2
(45) Date of Patent: Jul. 9, 2024

(54) SCREW COMPRESSOR WITH MULTI-LAYERED COATING OF THE ROTOR SCREWS

(71) Applicant: KAESER KOMPRESSOREN SE, Coburg (DE)

(72) Inventors: Andreas Foerster, Coburg (DE); Gerald Weih, Coburg (DE)

(73) Assignee: KAESER KOMPRESSOREN SE, Coburg (DE)

( * ) Notice: Subject to any disclaimer, the term of this patent is extended or adjusted under 35 U.S.C. 154(b) by 0 days.

(21) Appl. No.: 18/296,163

(22) Filed: Apr. 5, 2023

(65) Prior Publication Data

US 2023/0258180 A1 Aug. 17, 2023

Related U.S. Application Data

(63) Continuation of application No. 16/610,291, filed as application No. PCT/EP2018/060673 on Apr. 26, 2018, now Pat. No. 11,649,823.

(30) Foreign Application Priority Data

May 3, 2017 (EP) ..... 17169341

(51) Int. Cl.
*F04C 18/16* (2006.01)
*F01C 1/16* (2006.01)
(Continued)

(52) U.S. Cl.
CPC ..... *F04C 18/16* (2013.01); *F04C 18/084* (2013.01); *F04C 27/009* (2013.01);
(Continued)

(58) Field of Classification Search
CPC ..... F04C 18/16; F04C 18/08; F04C 15/00; F04C 2230/91; F01C 1/16; F05B 2230/90
See application file for complete search history.

(56) References Cited

U.S. PATENT DOCUMENTS 3,502,453 A 3/1970 Baratto
4,056,478 A 11/1977 Capelli
(Continued)

FOREIGN PATENT DOCUMENTS

CN 101096079 A 1/2008
CN 103216447 A 7/2013
(Continued)

OTHER PUBLICATIONS

International Search Report and Written Opinion for PCT/EP2018/060673; mailed Jul. 5, 2018 (13 pages; no English translation).
(Continued)

*Primary Examiner* — Deming Wan
(74) *Attorney, Agent, or Firm* — Myers Bigel, P.A.

(57) ABSTRACT

The invention relates to a screw compressor comprising a compressor housing (11) having two rotor screws (1, 2) mounted axially parallel therein, which mesh with each other in a compression space (18), can be driven by a drive and are synchronized with each other in their rotational movement, wherein the rotor screws (1, 2) each have a single-part or multi-part base body (24) with two end faces (5*a*, 5*b*, 5*c*, 5*d*) and a profiled surface (12*a*, 12*b*) extending therebetween, and shaft ends (30) projecting beyond the end faces (5*a*, 5*b*, 5*c*, 5*d*), wherein at least the profiled surface (12*a*, 12*b*) is formed in multiple layers, comprising a first, inner layer (3) and a second, outer layer (4), wherein the first, inner layer (3) and the second, outer layer (4) both comprise or are formed from a thermoplastic synthetic material, wherein particles (25) or pores (32) supporting a running-in process are embedded in the second, outer layer (4) and the thermoplastic synthetic material defines a matrix for receiving the particles (25) or for forming the pores (32).

20 Claims, 12 Drawing Sheets

(51) Int. Cl.
*F04C 15/00* (2006.01)
*F04C 18/08* (2006.01)
*F04C 27/00* (2006.01)

(52) U.S. Cl.
CPC ..... *F04C 2230/91* (2013.01); *F04C 2240/20* (2013.01); *F04C 2240/30* (2013.01); *F04C 2240/50* (2013.01)

(56) References Cited

U.S. PATENT DOCUMENTS

| | | | | |
|---|---|---|---|---|
| 4,077,922 | A | 3/1978 | Farrissey et al. | |
| 4,466,785 | A | 8/1984 | Biswas | |
| 4,847,135 | A | 7/1989 | Braus et al. | |
| 5,011,389 | A | 4/1991 | Timuska | |
| 5,223,052 | A | 6/1993 | Yamamoto et al. | |
| 5,314,321 | A * | 5/1994 | Yamamoto | F01C 21/08 418/178 |
| 5,364,250 | A * | 11/1994 | Aoki | F01C 21/08 418/179 |
| 5,401,149 | A * | 3/1995 | Tsuru | F04C 18/16 418/179 |
| 5,554,020 | A | 9/1996 | Rao et al. | |
| 6,482,873 | B1 | 11/2002 | Beckmann et al. | |
| 6,498,127 | B1 | 12/2002 | Niwa et al. | |
| 6,506,037 | B1 | 1/2003 | Bush et al. | |
| 7,703,983 | B2 | 4/2010 | Tsutsui et al. | |
| 8,801,412 | B2 | 8/2014 | Ikeda et al. | |
| 9,321,906 | B2 | 4/2016 | Takeishi et al. | |
| 9,435,340 | B2 | 9/2016 | Doepker et al. | |
| 9,605,677 | B2 | 3/2017 | Heidecker et al. | |
| 9,982,715 | B2 | 5/2018 | Gorges et al. | |
| 11,649,823 | B2 | 5/2023 | Foerster et al. | |
| 2003/0126733 | A1 | 7/2003 | Bush et al. | |
| 2008/0248269 | A1 | 10/2008 | Shibuya et al. | |
| 2010/0095837 | A1 | 4/2010 | Suman | |
| 2011/0076480 | A1 | 3/2011 | Skoog et al. | |
| 2012/0100029 | A1* | 4/2012 | Ikeda | F04C 18/16 418/201.1 |
| 2013/0020522 | A1 | 1/2013 | Hunter et al. | |
| 2013/0181362 | A1* | 7/2013 | Kitchloo | B29C 45/62 264/109 |
| 2014/0023540 | A1 | 1/2014 | Heidecker et al. | |
| 2014/0295059 | A1 | 10/2014 | Russo | |
| 2015/0003996 | A1 | 1/2015 | Krishna et al. | |
| 2015/0133351 | A1 | 5/2015 | Pasternak et al. | |
| 2015/0300340 | A1 | 10/2015 | Ishida et al. | |
| 2016/0169009 | A1 | 6/2016 | Okamoto et al. | |

FOREIGN PATENT DOCUMENTS

| | | | |
|---|---|---|---|
| CN | 104662199 | A | 5/2015 |
| CN | 105710789 | A | 6/2016 |
| EP | 0109823 | A1 | 5/1984 |
| EP | 0255870 | A2 | 2/1988 |
| EP | 0705979 | A1 | 4/1996 |
| ES | 1052890 | U | 3/2003 |
| GB | 678057 | A | 6/1946 |
| GB | 1440550 | A | 6/1976 |
| JP | H0710965 | B2 | 2/1995 |
| JP | H08121361 | A | 5/1996 |
| JP | 2000034991 | A | 2/2000 |
| KR | 19980061640 | A | 10/1998 |
| WO | 2008088600 | A1 | 7/2008 |
| WO | 2013142988 | A1 | 10/2013 |
| WO | 2016013558 | A1 | 1/2016 |

OTHER PUBLICATIONS

Opposition against European Patent No. 3399191 in the name of Kaeser Kompressoren SE by Atlas Copco Airpower, Mar. 4, 2021 (43 pages).

Additional Response to Opposition against European Patent No. 3399191 in the name of Kaeser Kompressoren SE by Atlas Copco Airpower, Oct. 13, 2021 (5 pages).

Matweb—Material Property Data, "Shore (Durometer) Hardness Testing of Plastics", Retrieved from: http://web.archive.org/web/20170427043252/http://matweb.com/reference/shore-hardness.aspx; Archived Apr. 27, 2017 via the Wayback Machine (3 pages).

Third Party Ex Parte Reexamination Request of U.S. Pat. No. 11,649,823; Filed Nov. 29, 2023, (138 pages).

Written Decision of Invalidation Request corresponding to CN 201880028981.7; Dated Mar. 7, 2024, (78 pages, including English translation).

* cited by examiner

SCREW COMPRESSOR WITH MULTI-LAYERED COATING OF THE ROTOR SCREWS

RELATED APPLICATIONS

The present application is a continuation of U.S. patent application Ser. No. 16/610,291, filed Mar. 19, 2020, which is a 35 U.S.C. § 371 national phase application of PCT International Application No. PCT/EP2018/060673, filed Apr. 26, 2018, which claims priority from European Patent Application No. 17169341.9, filed May 3, 2017, the disclosures of which are hereby incorporated herein by reference in their entireties.

DESCRIPTION

The invention relates to a screw compressor comprising a compressor housing having two rotor screws mounted axially parallel therein, which mesh with each other in a compression space, can be driven by a drive and are synchronized with each other in their rotational movement, wherein the rotor screws each have a single-part or multi-part base body with two end faces and a profiled surface extending therebetween and shaft ends projecting beyond the end faces, and a method for applying a multilayer coating to a metallic surface of a rotor screw or a compression space of a screw compressor.

Screw machines, whether as screw compressors or screw expanders, have been in practical use for several decades. Designed as screw compressors, they have displaced reciprocating compressors as compressors in many areas. With the principle of the interlocking screw pair in the form of the rotor screws, not only gases can be compressed by using a certain amount of work. The application as a vacuum pump also opens up the use of screw machines to achieve a vacuum. Finally, the passage of pressurized gases in the opposite direction can also generate a work output, so that mechanical energy can also be obtained from pressurized gases using the principle of the screw machine.

Screw machines generally have two rotor screws arranged axially parallel to each other, one of which defines a main rotor and the other a secondary rotor. The rotor screws each have a single-part or multi-part base body with two end faces and a profiled surface extending therebetween as well as two shaft ends projecting in each case beyond the end faces.

The rotor screws mesh with each other with corresponding helical teeth. Between the gearings and a compressor housing, several successive working chambers are formed by the tooth gap volumes. Starting from a suction area, as the rotor screws rotate progressively, the respectively considered working chamber is first closed and then continuously reduced in volume so that compression of the medium occurs. Finally, as the rotation progresses, the working chamber is opened towards a pressure window and the medium is pushed out into the pressure window. Due to this process of internal compression, screw machines designed as screw compressors differ from roots blowers which operate without internal compression.

The meshing of the two rotor screws defines a pitch circle both for the rotor screw designed as the main rotor and for the rotor screw designed as the secondary rotor. The pitch circles can be represented in a face section of the gearing and it can be seen in such a representation that the pitch circles roll against each other when the rotor screws move. On the pitch circles, the circumferential speeds of the rotor screw designed as the main rotor and the rotor screw designed as the secondary rotor are identical, i.e. there is no relative speed between the two rotor screws in this area. However, the further one moves radially away from the pitch circles within the profiled surface, the greater the relative speeds.

Besides the already mentioned function as vacuum pump or screw expander, screw machines can be used as compressors in different fields of technology. A particularly preferred field of application is the compression of gases such as air or inert gases (helium, nitrogen, argon, . . . ). However, it is also possible to use a screw machine for compressing refrigerants, for example for air conditioning systems or refrigeration applications, even though this especially leads to different constructional requirements. When the term "compressed air" or "gases" is used in the following, it refers to all process media that are compressed or expanded. When compressing gases, especially at higher pressure conditions, fluid-injected compression, in particular oil- or water-injected compression, is usually used; however, it is also possible to operate a screw machine, in particular a screw compressor, according to the principle of dry compression. With oil-free compression, no oil is injected into the compression space for cooling and lubrication. The compressed air does not come into contact with oil during the compression process. In the low-pressure range, screw compressors are occasionally referred to as screw blowers.

The invention relates to an oil-free, in particular dry compression. Typical pressure ratios for dry compression can be between 1.1 and approx. 10, wherein the pressure ratio is the ratio of final compression pressure to intake pressure. Compression can take place in one or more stages. The ultimate pressures that can be achieved, especially with single-stage or two-stage compression, can range from 1.1 bar to approx. 10 bar. Where reference is made at this point, or subsequently in this application, to pressure data in "bar", such pressure data shall refer in each case to absolute pressures.

The invention relates to screw machines, in particular screw compressors, whose rotor screws characteristically are not synchronized by profile engagement between the two rotor screws, but externally, for example by a synchronous gear on the shaft ends or by separate and electronically synchronized rotor drives. In these screw machines rotor contact only occurs temporarily, e.g. due to geometric deviations of the nominal contour of the rotor screw or rotor screws or due to thermal differential expansions, and is eliminated by material removal of a coating provided on the rotor screws at the contact and friction points. This removal of a contact provided only temporarily between the rotor screws takes place in a running-in process. Rotor screws are usually made of steel or cast iron. The compressor housing is typically cast in grey cast iron. There must be a small gap between the rotor screws and the compressor housing and especially between the two rotor screws. These components must not touch each other during operation, as a metallic contact would lead to tarnishing due to the high speeds and in the worst case to seizure. The gap between the rotor screws is achieved by operating both rotor screws synchronously, for example by means of a synchromesh gearbox or separate, electronically synchronized rotor drives.

On the one hand, the gaps should be as small as possible in order to minimize backflow of the compressed air into previous working chambers (i.e. in the opposite direction to the conveying direction). The more backflow occurs, the higher the internal losses and the poorer the efficiency of the screw machine. In the case of a screw compressor, the final compression temperature also rises significantly with increasing backflow, which leads to greater thermal expansion of the rotor screws and the compressor housing. The higher thermal expansion in turn increases the danger of tarnishing, i.e. a self-reinforcing effect is created.

On the other hand, the gaps should also be sufficiently large to ensure the required operational safety. If metallic surfaces come into contact at high relative speeds, this leads to high heat input and thermal expansion and ultimately also to seizure of the components, as already described above. When dimensioning the gap, therefore, in addition to the manufacturing tolerances, the thermal expansion due to high compression temperatures and the deflection of the rotor screws due to the pressure in the working chambers must also be taken into account.

A further requirement for oil-free, in particular dry compression is the guarantee of good corrosion protection of the rotor screws and the compressor housing. After switching off the still hot screw compressor, condensation may form inside the compressor housing due to moisture in the air during cooling. There is also a risk of corrosion even with dry compression with reduced water quantity injection (the water essentially evaporates completely until the end of the compression process). Rotor screws and housings made of grey cast iron or conventional steel are particularly susceptible to corrosion.

It is known from the prior art that rotor screws are partly made of stainless steel. However, this is very expensive and costly to produce. The same applies to the compressor housing as to the rotor screws.

In the prior art, rotor screws of dry-running screw compressors are therefore coated with a fluoropolymer/sliding lacquer to eliminate the above-mentioned problems.

EP 2 784 324 A1, for example, describes the composition of a coating used to refurbish or overhaul the rotor screws of a dry-running screw compressor. The worn coating on the rotor screws is removed and replaced by a new coating. This coating consists of PTFE (specifically Teflon 954G 303), graphite and other solvents or thinners. According to the product data sheet of the manufacturer (Chemours), the substance 954G 303 is only suitable for continuous operating temperatures of 150° C. In addition, there are further requirements for environmental and health protection. Substance 954G 303 and other components of the prior art formulation contain solvents which are highly problematic during processing. There are also increasing legal requirements for a reduction of volatile organic compounds (VOCs). In addition, the substance 954G 303 is not food grade and therefore not FDA compliant. It is suspected of being carcinogenic.

In addition, the coating proposed in the prior art offers only limited corrosion protection because a layer is applied that contains comparatively much graphite. If this relatively soft layer is damaged, for example by scratches, the metallic base body of the rotor screw is locally exposed and there is therefore a risk of corrosion.

WO 2014/018530 proposes a coating of a high-performance thermoplastic (e.g. PEEK) as well as a first solid lubricant (e.g. MoS2) and a second solid lubricant (e.g. PTFE or graphite). However, it describes an application for compressors with low speeds and high loads at the same time. In addition, prior art coating technology provides that the coated surfaces are in constant frictional contact with each other.

Based on the first-mentioned prior art, the invention is based on the object of specifying a coating for an oil-free screw compressor with comparatively high rotational speeds of the rotor screws and a desired gap between the rotor screws themselves or between the rotor screws and a compressor housing, which avoids the disadvantages of the prior art and at the same time adjusts itself to a sufficiently small gap distance in a running-in process. This object is solved with respect to the device by a screw compressor, in particular an oil-free screw compressor.

A core idea of the present invention is that in a screw compressor or in a rotor screw, at least the profiled surface of the rotor screw is formed in several layers, comprising a first, inner layer and a second, outer layer, wherein the first, inner layer and the second, outer layer both comprise or are formed from a thermoplastic synthetic material, wherein in the second, outer layer particles or pores supporting a running-in process are embedded and the thermoplastic synthetic material defines a matrix for receiving the particles or for forming the pores.

A core idea of the method according to the invention is the application of a multi-part coating to a metallic surface of a rotor screw or a compression space of a screw compressor to be coated, comprising the following steps:

- Pre-treatment of the metallic surface to be coated,
- Application of a first, inner layer comprising or formed from a thermoplastic synthetic material to the metallic surface to be coated or to a sublayer which may in particular be formed as a pretreatment layer, and
- Application of a second, outer layer to the first, inner layer, wherein the second, outer layer also comprises or is formed from a thermoplastic synthetic material and wherein particles or pores supporting a running-in process are embedded in the second, outer layer and wherein the thermoplastic synthetic material defines a matrix for receiving the particles or for forming the pores.

The formation of the profiled surface as a multilayer layer allows the provision of sublayers with different properties. A special consideration, however, is that the second, outer layer is designed to be removed in a running-in process, optionally in certain areas or almost completely, so that the profiled surfaces of the intermeshing rotor screws are optimally adjusted to each other under the concrete conditions on site, i.e. under the respective given pressure conditions, temperature conditions, etc. In this respect, the second, outer layer is more or less a self-adjusting layer.

In the following, preferred embodiments for the screw compressor according to the invention or the rotor screw according to the invention are discussed, wherein at least some of them can easily be applied to the method according to the invention or are transferable to the method.

Preferably, the materials are chosen in such a way that in applications relating to foodstuffs the material removal or the contact of the compressed air with the first, inner layer and/or the second, outer layer is harmless, i.e. the materials are suitable for foodstuffs or in conformity with FDA regulations. According to a basic idea of the present invention, a thermoplastic synthetic material is generally used. Preferably, the thermoplastic synthetic material is a semi-crystalline thermoplastic synthetic material. Semi-crystalline thermoplastic synthetic materials are characterized by high fatigue strength, good chemical resistance and good sliding properties. They are also very wear-resistant.

In a preferred embodiment, the thermoplastic synthetic material is a high-performance thermoplastic synthetic material, in particular a semi-crystalline high-performance thermoplastic synthetic material. A high-performance thermoplastic synthetic material is a plastic with a continuous service temperature of >130° C., preferably >150° C. Preferably it is a thermoplastic concentrate, further preferably a polymer or copolymer with alternating ketone and ether functionalities, in particular a polyaryletherketone (PAEK). Special examples of polyaryletherketones (PAEK) are:

i. Polyetherketone (PEK)
ii. Polyetheretherketone (PEEK)
iii. Polyetherketoneketone (PEKK)
iv. Polyetherketoneketoneketone (PEKEKK)
v. Polyetheretheretherketone (PEEEK)
vi. Polyetheretherketoneketone (PEEKK)
vii. Polyetherketoneetheretherketone (PEKEEK)
viii. Polyetheretherketonetherketone (PEEKEK)

and/or copolymers thereof and/or mixtures thereof, wherein in particular polyetheretherketone (PEEK) is regarded as preferred. In a particularly preferred embodiment, the thermoplastic synthetic material for forming the first, inner layer and/or the thermoplastic synthetic material for forming the second, outer layer comprises polyetheretherketone (PEEK) or consists at least substantially of polyetheretherketone (PEEK).

Polyphenylene sulfide (PPS) and polyamides (PA), especially PA11 or PA12, can also be used as thermoplastic synthetic materials.

Further preferably, the thermoplastic base substance for forming the first, inner layer and for forming the second, outer layer comprises generally a polyaryletherketone (PAEK) or is at least substantially formed from PAEK. High-performance thermoplastic synthetic materials can also be described as high-performance thermoplastics or thermoplastic high-performance plastics.

In general, the first, inner layer and the second, outer layer are structurally different, even if the same thermoplastic synthetic material is used, for the multilayer structure of the layers comprising thermoplastic synthetic material according to the present invention. The first, inner layer is preferably particle-free or pore-free or in any case has a lower proportion of particles and/or pores than the second, outer layer, preferably a significantly lower proportion of particles and/or pores. The proportion of thermoplastic synthetic material in the first, inner layer based on the total mass is at least 60 wt. %, preferably at least 70 wt. %, more preferably at least 80 wt. %, more preferably at least 95 wt. %, more preferably at least 100 wt. %. The proportion of thermoplastic synthetic material in the second, outer layer is preferably at least 50 wt. % and, when particles are used in the second, outer layer, at most 95 wt. %, wherein a minimum proportion of 5 wt. % of particles, more preferably 10 wt. % of particles is provided. If, on the other hand, instead of particles, only pores are provided in the second, outer layer, the proportion of thermoplastic synthetic material in the second, outer layer can also exceed 95 wt. %. The volume fraction of pores in the second, outer layer is preferably above 5%, further preferred above 10%, whereas the volume fraction of pores in the first, inner layer is below 5%, preferably below 2%.

Furthermore, the first, inner layer is preferably composed of particles or pores which do not support a running-in process but is formed at least essentially homogeneous. Of course, this does not concern an abstract theoretical homogeneity, but the first, inner layer is formed relatively homogeneous in relation to the second, outer layer, which comprises particles or pores that support the running-in process, and in any case has no inhomogeneities that have been specifically introduced.

In one possible embodiment, the particles of the second, outer layer that support a running-in process include abrasive and/or lubricating particles. It is therefore possible to provide a second, outer layer only with abrasive particles or alternatively only with lubricating particles. Furthermore, it is possible to provide both abrasive and lubricating particles in the second, outer layer. Finally, it is conceivable to define areas where only abrasive particles or only lubricating particles are provided, or areas where both types are intended to be mixed, wherein the ratio of the abrasive particles to the lubricating particles may also change over different areas of the second, outer layer.

According to a preferred embodiment, the particles include or are formed from microspheres, in particular of aluminum dioxide ($Al_2O_3$), silicon dioxide ($SiO_2$), thermoplastic synthetic material or glass, in particular borosilicate glass. Microspheres are very light, hollow spheres of microscopic dimension, filled with air or inert gas. The shell of the microspheres may consist of one of the following materials: aluminum dioxide ($Al_2O_3$), silicon dioxide ($SiO_2$) or glass and the latter in particular borosilicate glass. Borosilicate glass balls that are hollow on the inside are offered by 3M as "glass bubbles", for example. They are available in powder form, are chemically inactive, non-combustible and non-porous. An average ball diameter, for example, is 20 μm with an average wall thickness of 0.7 μm. When such glass microspheres are used, they burst during the running-in process. Due to their hardness (they are much harder than the binder matrix of the second, outer layer), they also provide the necessary abrasion and offer local, tiny points of attack uniformly distributed over the surface for coating removal on friction contact with an opposite surface, for example the opposite rotor screw, thus avoiding undesirable or damaging large-area flaking of the layers with the respective opposite surface, such as the profiled surface of an opposite rotor screw or contact between rotor screw and compressor housing.

In an optionally possible embodiment of the present invention, the particles of the second, outer layer supporting a running-in process exhibit a higher hardness than the matrix defined by the thermoplastic synthetic material, wherein the hardness is measured or defined according to Shore.

In an embodiment of the present invention that is also optionally possible, the particles of the second, outer layer that support a running-in process have a lower hardness than the matrix defined by the thermoplastic synthetic material, wherein the hardness is measured or defined according to Shore.

According to a particularly preferred aspect of the present invention, the first, inner layer is joined to the second, outer layer by melting. This results in a particularly stable, durable and reliable connection between the first, inner layer and the second, outer layer. This ensures a relatively reliable anchoring of the second, outer layer, even if the second, outer layer has a comparatively high proportion of particles or pores and, for example, would thus have relatively poor adhesive properties if it were applied theoretically directly to the metallic base or to a metallic surface. In this context, it should also be noted that the proportions of particles relative to the proportion of thermoplastic synthetic material, in particular a thermoplastic high-performance synthetic material, in particular PEEK, can be expressed by weight and, for example, the particle-binder mass ratio can be expressed as P/B. The binder is the aforementioned matrix made of thermoplastic synthetic material for the accommodation of the particles.

In order that the respective properties of the particles in the second, outer layer can be used and have an effect, minimum quantities are to be specified preferentially. On the other hand, particles cannot be increased arbitrarily. The particles are bound in the binder, i.e. the matrix made of the thermoplastic synthetic material. The higher the particle content, the stronger the effect of the particle properties, but the more difficult it is to bind the particles themselves in the binder matrix, especially in PEEK. The following applies advantageously to the total particle proportion:

$0.03 \leq PB \leq 1.0$ related to the respective mass conditions. A preferred range for the total filler content is $0.15 \leq PB \leq 0.35$.

Alternatively, the following can also be defined as preferred ranges for concrete particles:

Particle: Graphite: $0.3 \leq P_{Graphite}/B \leq 0.75$ with $P_{Graphite}$ as mass of the graphite.

Particle: Hollow glass spheres: $0.05 \leq P_{Hollow\ glass\ spheres}/B \leq 0.5$ with $P_{Hollow\ glass\ spheres}$ as mass of the hollow glass spheres.

After a preferred consideration of the present invention, the first, inner layer defines an essentially homogeneous coating and thus a corrosion protection layer for the metallic surface covered by the first, inner layer. As already mentioned, the first, inner layer can be provided as a very homogeneous layer which adheres well to the metallic surface to be coated and thus offers good corrosion protection.

According to another preferred aspect of the present invention the second, outer layer is defined as a layer that is ablated and/or plastically deformed in certain areas during the running-in process and therefore adapts to the specific operating conditions. The running-in layer is designed in such a way that it can adapt to the concrete operating conditions and ensure a favorable gap dimension in relation to a counter surface.

According to a further advantageous embodiment of the present invention, the particles absorbed in the second, outer layer comprise graphite or may be formed from graphite. Particles may also include the following materials: hexagonal boron nitride, carbon nanotubes (CNT), talc (or talcum), polytetrafluoroethylene (PTFE), perfluoroalkoxy polymers (PFA), fluoroethylene-propylene (FEP) and/or another fluoropolymer.

Graphite, hexagonal boron nitride, carbon nanotubes and talc reduce friction as solid lubricants in each case. The materials can be removed relatively well, i.e. a favorable running-in behavior is achieved. Graphite is relatively soft relative to the binder matrix. Talc is also comparatively soft and acts as a lubricant with a low abrasive effect. It is also water repellent and sealing.

Fluoropolymers such as PTFE, PFA, FEP (with average grain sizes of approx. 2 μm to 30 μm) also act as solid or dry lubricants. They are mixed in powder form with the thermoplastic synthetic material of the binder matrix, such as PEEK, and do not dissolve even in wet paint in the subsequent processes for forming the second, outer layer. They are rather soft relative to the binder matrix and therefore provide good lubricating, sliding and non-stick properties.

The particles can include the following materials alternatively or additionally: aluminum dioxide ($Al_2O_3$), silicon carbide (SiC), silicon dioxide ($SiO_2$) and/or glass (especially borosilicate glass).

Alternatively or in addition to the particles, pores can also be incorporated in the second, outer layer. Pores are hollow spaces which have an expansion of at least 1 μm in at least one of the largest dimensions. The incorporation of such pores in the manufacturing process can be achieved, for example, by mixing in suitable foams (e.g. chemical additives which act as blowing agents). The pores can form an open-pored or closed-pored structure. The pores are advantageously a maximum of a few micrometers in size and are further advantageously distributed at least substantially homogeneously within the second, outer layer.

Pore-like cavities can also be created by microspheres with thermoplastic shells (plastic microspheres). The thermoplastic shell encloses a gas that expands through the supply of heat and increases the volume of the hollow sphere. Such microspheres from a plastic shell can be present as particles in expanded or non-expanded form. A polymer matrix with hollow particles embedded in it is sometimes referred to in technical literature as syntactic foam. It should also be mentioned that plastic microspheres in particular can be used to create functional textures on the surface of the coating. This allows, for example, the advantageous influence of gap flows.

The incorporation of pores or pore-like cavities into the second, outer layer causes the second, outer layer to compress plastically to the required layer thickness during the running-in process, thus automatically achieving a relatively good gap dimensioning.

According to a further advantageous embodiment, the particles are present in microencapsulated form. In microencapsulation, at least one first substance (active substance) is surrounded by a second substance (the envelope material or shell). A distinction is made between monolithic microcapsules with a solid core and reservoir microcapsules with a liquid core. The shell consists of plastic, for example. Advantages of microencapsulated particles are in particular:

Better handling before or during processing (better flow properties, less dust generation)

Better dispersibility. A water-insoluble substance can be enclosed in microcapsules so that it is dispersible in an aqueous medium. Electrostatic charging or the risk of gradual agglomeration can also be reduced by encapsulation.

Possibility of combining incompatible substances

Prevention of premature chemical reactions with other mixing components

Influencing electrostatic properties

In an advantageous embodiment, microencapsulated lubricants embedded in the second, outer layer are mainly released in the running-in phase when subjected to mechanical stress. This allows the running-in process to be extended, for example. This results in less frictional heat and, as a result, a lower risk of eruptions of the second, outer layer. It is obviously conceivable to incorporate further particles or pigments, such as titanium dioxide ($TiO_2$), into the second, outer layer.

In a preferred embodiment, the layer thickness of the first, inner layer before running-in is between 5 μm and 50 μm. In order to achieve a layer thickness of, for example, 50 μm, the first, inner layer can also be applied in several layers, e.g. two layers of 25 μm each, in order to achieve a total layer thickness of 50 μm for the first, inner layer. The layer thickness here is always the dry film thickness (DFT).

The layer thickness of the second, outer layer before running-in is preferably 10 μm to 120 μm. The dry film thickness (DFT) is also addressed here. The second, outer layer can also be applied in several layers. It is advantageous to make the layer thickness thicker the larger the diameter of the rotor screws is. The total thickness of the first, inner layer and the second, outer layer can therefore preferably be in the range of 15 μm to 170 μm.

The gaps and layer thicknesses are ideally matched to each other in such a way that there is minimal clearance between the rotor screws and between the rotor screws and the compressor housing when the rotor screws are mounted in the compressor housing. The mounted rotor screws should just be able to be turned against each other. If the layer thickness is so large that an oversize occurs, the rotor screws can only be mounted in the housing using force and constraint. The play during assembly is advantageous because the rotor screws can then be synchronized, for example via a synchronous gear, in a defined manner. The relative angle of rotation of the rotor screws to each other is permanently fixed.

The second, outer layer adheres better to the first, inner layer than directly to the metallic surface of the component to be coated, for example to the base body of the rotor screw. This is because the thermoplastic synthetic material, such as PEEK, of the second layer, fuses with the thermoplastic synthetic material, such as PEEK, of the first layer. With increasing particle content, the proportion of the thermoplastic synthetic material in the binder matrix, especially the PEEK content, decreases accordingly. As a result, the function of thermoplastic synthetic material, especially PEEK, as a binder matrix is also weakened.

If the second, outer layer were applied directly to the metallic surface, for example to the base body of the rotor screw, the greater the proportion of particles, the less binder matrix would be available that could bond to the metallic surface.

When the screw compressor is put into operation—as already mentioned—the compression temperature causes thermal expansion and bending of the rotor screws due to the compression temperature and consequently a contact between the rotating rotor screws and the stationary compressor housing. This contact results in partial removal of the second, outer layer. The rotor screws wear locally to different degrees and only where components touch. Depending on the respective deformations and deviations from the nominal geometry of the rotor screws and, if applicable, the compressor housing, the second, outer layer is partially removed to different extents. As already mentioned, this ablation is referred to as the running-in process and should only take place in the second, outer layer, the running-in layer. The running-in process essentially takes place only once, when the screw compressor is put into operation for the first time. It is advantageous to carry out the running-in process carefully. It is advantageous to adapt the running-in process to the later area of application of the screw compressor. A variable-speed drive (e.g. permanent magnet motor or synchronous reluctance motor) of the screw compressor is particularly advantageous for a gentle running-in process. This enables the drive speed to be increased during the running-in process in a defined and time-stretched manner up to the maximum intended operating speed. In contrast, a fixed speed drive (e.g. with a conventional asynchronous motor without frequency converter) would drive the screw compressor very quickly at the high speed required for dry compression with the risk that the coating could be damaged due to the extremely short running-in process. The running-in process can, for example, take place on a separate running-in test bench. Advantageously, however, the entire machine (screw machine incl. drive etc.) is already equipped with a variable-speed drive so that the running-in process can take place during the initial commissioning of the machine intended for the customer. The time-consuming intermediate step (assembly and disassembly on the running-in test bench) could thus be omitted. In this way, an unnecessarily high removal of the second, outer layer can be avoided, which would otherwise lead to an increased undesired backflow in the opposite direction to the conveying direction.

The hard or abrasive particles absorbed in the second, outer layer ensure that the softer material of the friction partner is removed. Comparatively soft particles (relative to the hardness of the thermoplastic synthetic material, which defines the binder matrix) ensure that the second, outer layer in which they are present can be removed particularly quickly and easily by a harder friction partner. In contact areas in the profile area of the rotor sections with no or low relative speeds of the two rotor screws to each other during operation (i.e. in or near the pitch circles or rolling areas), high surface pressures occur simultaneously, so that, for example, the thin-walled hollow glass microspheres in the second, outer layer break open advantageously and thus provide the necessary abrasion or loss of layer thickness in the second, outer layer on both rotor screws. According to a preferred aspect of the present invention, the sharp breaking edges of the hollow glass microspheres created during breaking support the abrasive process. A loss of layer thickness can also be achieved by pores enclosed in the second, outer layer, where plastic deformation occurs due to compression or collapse of the pores.

This prevents unwanted constant pressing of the rotor screws against each other. Among other things, this has a positive effect on the service life of the coating and on the service life of the bearings. Overall, this adaptability of the second, outer coating, especially in or near the rolling area of the screw rotors, improves the running smoothness of the screw compressor in an advantageous way.

In contact areas of the rotor screws with comparatively high relative speeds, i.e. in areas with increasing radial distance to the pitch circles, soft particles, such as graphite, can be removed relatively easily due to the high relative speeds of the friction partners, i.e. the second, outer layer also enters these areas well. Graphite in particular also has the advantage that it is comparatively inexpensive and does not spread on the counter surface.

According to a preferred embodiment of the present invention, the base body of the rotor screw is made of steel and/or cast iron.

In accordance with the invention, it is also advantageous to coat further sections of one or both rotor screws and the compressor housing in a corresponding multilayer manner in addition to the profiled surface or surfaces.

With respect to the rotor screw itself, the end faces may still be coated with a first, inner layer and a second, outer layer, wherein the first, inner layer and the second, outer layer both comprise or are formed from a thermoplastic synthetic material and the second, outer layer has particles or pores supporting a running-in process, the thermoplastic synthetic material defining a matrix for receiving the particles or for forming the pores. However, it may also be provided that only one of the two end faces, preferably only the end face on the pressure side, as described above, is coated with both the first, inner layer and the second, outer layer, whereas the opposite end face is coated with only the first, inner layer.

Furthermore, sections of the shaft ends can still be coated with thermoplastic synthetic material according to the first, inner layer. Advantageously, however, sections of the shaft ends are also uncoated, i.e. provided without a layer of thermoplastic synthetic material according to the present invention. Any other coating of these sections is unaffected.

The functional areas of a compressor housing essentially consist of a suction area, the rotor bore, a pressure area as well as seal and bearing seats. In the case of a screw compressor, the process medium, for example the air to be compressed, flows from the suction area to the rotor bore and through a pressure window further to the pressure area.

The suction area is located on the inlet side of the compressor housing and extends from a suction port of the compressor housing to the rotor bore. In the rotor bore, which comprises two partial bores matched to the rotor screws, the rotor screws are each mounted with very small gaps (radial housing gaps) and form working chambers within the compression space. The compression space is the inner space defined by the rotor bore in the compressor housing. A flat end face in the compressor housing with a very small axial gap to the two pressure-side rotor end faces is referred to as the pressure-side housing end face. Accordingly, the end face in the compressor housing with the shortest axial distance to the suction-side rotor end faces is referred to as the suction-side housing end face.

The pressure range extends from the end of the compression space to a discharge port of the compressor housing.

Seal seats in the compressor housing (seal seats on the housing side) serve to accommodate seals, specifically air or pumped medium seals and oil seals. In the following, the term air seal should always be understood as a seal for other fluids. Likewise, the term "oil seal" should always be understood to include a seal for other bearing lubricants.

Bearings (e.g. roller bearings) for the two rotor screws are mounted in bearing seats in the compression housing. Seal seats (seal seats on the rotor side) are also provided on the shaft ends of the rotor screws. A distinction is made between sealing seats for air seals and sealing seats for oil seals, which are typically arranged next to each other on the shaft ends of the rotor screws. The seal seats for the air seals are located on both sides of the rotor screw in close proximity to the suction-side and pressure-side rotor end faces. The seal seats for the oil seals are arranged next to and further away from the rotor end faces.

The oil seals prevent oil from penetrating from the bearing area into the compression area of the screw compressor. The air seals, on the other hand, prevent the compressed air or the compressed conveying fluid from escaping from the compression space.

Bearing seats are also provided on the shaft ends, on which, for example, the rolling bearings are located. The bearing seats are usually connected to the seal seats.

It is advantageous—as already mentioned in part—to additionally coat the profiled surface of the rotor screws with additional sections of the rotor screws as well as the compressor housing. The entire interior of the compressor housing, which comes into contact with the fluid to be conveyed, for example the air to be compressed, can be coated with a first, inner layer comprising or formed from a thermoplastic synthetic material. This area to be coated consists of

- the suction area (from the suction port of the screw compressor to the beginning of the compression space),
- the rotor bore with the partial sections for both rotor screws,
- the two housing end faces (suction-side and pressure-side housing end face),
- the pressure range (from the end of the compression space to the discharge port of the screw compressor)

and the seal seats.

The rotor bore with the two subsections for both rotor screws can advantageously be coated in addition to the first, inner layer with the second, outer layer according to the invention, which has particles or pores supporting a running-in process and in which the thermoplastic synthetic material defines a matrix for receiving the particles or for forming the pores. A second, outer layer of this type can also be applied to the pressure-side housing end face. The suction area and pressure area can also be provided with such a second, outer layer. However, it is also possible alternatively to apply another corrosion protection layer to the suction area and the pressure area instead of the first, inner layer proposed here or the combination of the first, inner and second, outer layer proposed here. The seal seats in the housing can also be provided with a second, outer layer in accordance with the invention. As an alternative to coating the seal seats with a first, inner layer or a first, inner layer and a second, outer layer, it is also possible that the seal seats in the housing remain uncoated. "Uncoated" is to be understood here in the sense that the seal seats in the housing are not provided with a first, inner layer and/or a second, outer layer, i.e. not with a coating according to the present invention. The bearing seats in the housing, on the other hand, must not be coated. Here, too, the bearing seats must not be provided with a coating in accordance with the invention; this does not apply to any other coating, in particular a film-like coating, for example to increase the sliding properties.

The function of the running-in layer between the rotor screw as the moving part and the compression space of the compressor housing as the stationary part is very similar to that described above, i.e. when the screw compressor is put into operation, thermal expansion of the rotor screws and the compressor housing occurs due to the compression temperature, and the rotor screws bend. As a result, for example, rotor screws and rotor bore may come into contact with each other, or rotor end faces and housing end faces, in particular the pressure-side rotor end face and the pressure-side housing end face, may come into contact with each other. During this contact, the partial removal of the second, outer coating takes place as intended by the invention. The end faces run in accordingly. It should be noted here that the pressure-side axial end gap is particularly important for efficient compression. Ideally, this end gap should be very small. The pressure-side axial end gap is set in a defined manner when the rotor screws are mounted in the compressor housing (usually with an accuracy of less than 1/100 mm and e.g. by means of spacers). It is also particularly important for efficient compression that the radial gap between rotor screws and rotor bore is very small.

The following coating variants in particular are conceivable as possible embodiment examples, although this list is by no means exhaustive and further combinations are conceivable:

| | Rotor screw 1 (e.g. secondary rotor) (profile area | Rotor screw 2 (e.g. main rotor) (profile area) | Pressure-side rotor end face | Suction-side rotor end face | Rotor bore in the housing | Pressure-side housing end face |
|---|---|---|---|---|---|---|
| Variant 1 | First, inner layer + | First, inner layer + | First, inner layer + | First, inner layer + | First, inner layer + | First, inner layer + Second, outer |

-continued

| | Rotor screw 1 (e.g. secondary rotor) (profile area | Rotor screw 2 (e.g. main rotor) (profile area) | Pressure-side rotor end face | Suction-side rotor end face | Rotor bore in the housing | Pressure-side housing end face |
|---|---|---|---|---|---|---|
| | Second, outer layer (hard) | Second, outer layer (hard) | Second, outer layer (hard) OR | Second, outer layer (hard) OR | Second, outer layer (hard) OR | layer (hard) OR First, inner layer + Second, outer layer (soft) OR First, inner layer |
| Variant 2 | First, inner layer + Second, outer layer (soft) | First, inner layer + Second, outer layer (soft) | First, inner layer + Second, outer layer (soft) OR | First, inner layer + Second, outer layer (soft) OR | First, inner layer + Second, outer layer (soft) OR First, inner layer | |
| Variant 3 | First, inner layer + Second, outer layer (hard) | First, inner layer + Second, outer layer (soft) | First, inner layer | First, inner layer | | |
| Variant 4 | First, inner layer | First, inner layer + Second, outer layer (soft) | | | | |

In a preferred embodiment of the present invention, the screw compressor is an oil-free compressing, in particular dry compressing screw compressor.

In the aforementioned coating process, the core consideration consists in applying a second, outer layer to a first, inner layer comprising or formed from a thermoplastic synthetic material, wherein the second, outer layer also comprises or is formed from a thermoplastic synthetic material and wherein particles or pores supporting a running in process are embedded in the second, outer layer and the thermoplastic synthetic material defines a matrix for receiving the particles or for forming the pores. The specified steps are also preferably performed in the specified order.

The various material possibilities for the thermoplastic synthetic material, which is a so-called high-performance thermoplastic synthetic material, have already been discussed in connection with the device aspects of the present invention. Reference is made to these comments here. In general, it is again stated that the thermoplastic synthetic material can be a polyaryletherketone (PAEK), wherein polyetheretherketone (PEEK) is regarded as particularly preferred.

The coatings can, for example, be applied as a water-based wet paint coating with conventional spray coating equipment (e.g. HVLP guns, electrostatic, airless) or electrostatically as a powder coating manually or robot-controlled. Robot-controlled painting offers the advantage of high process reliability with uniform coating thicknesses and small tolerances.

With regard to the production of powder coating or wet coating, the following should be noted with regard to the coating envisaged here:

Powder coating: Particles in powder form are added to the thermoplastic synthetic material, which is also usually in powder form, in particular the PEEK, which is in powder form.

Wet paint: Particles and thermoplastics, especially PEEK, are mixed in powder form, preferably in water with dispersing agent. The particles and the PEEK powder do not dissolve in the dispersion but form a suspension. In particular, when using a wet coating process for the application of the first, inner layer, the first layer must be ventilated. This ventilation of the first layer preferably includes heating of the coated wet components to approx. 120° C. to evaporate the water over a specified period of time. Only then should the second, outer layer be applied wet or dry.

The first, inner layer and/or the second, outer layer can be applied as wet paint or powder coating. According to another preferred aspect of the invention, the first, inner layer and the second, outer layer are baked in such a way that the thermoplastic synthetic material melts. In this respect, baking can take place after each layer has been applied; alternatively, it is also conceivable to apply the two or more layers first and then bake them in a single baking process.

The first, inner layer and the second, outer layer are preferably baked at temperatures of approx. 360° C. to 420° C. until the thermoplastic synthetic material, in particular the PEEK, has melted and forms a homogeneous layer which adheres sufficiently to the surface to be coated. Burning in can take place in particular in the convection oven or inductively. Optionally, as already mentioned, baking in is also possible after the application of each layer. Finally, it should be mentioned that it is also possible to increase the thickness of the second, outer layer and to subsequently treat it to achieve the desired thickness, in particular to regrind it.

Before applying the first, inner layer, the metallic surface to be coated should be pretreated. This pretreatment preferably includes degreasing and further preferably further conditioning of the metallic surfaces, for example by roughening the surfaces, blasting or etching or by applying a pretreatment layer defining a conversion layer, e.g. phosphating or applying a nanoceramic. The surface pretreatment can also include sandblasting and subsequent chemical cleaning with a suitable solvent (e.g. alkaline cleaner, acetone) to promote good adhesion of the first, inner layer. Degreasing can be advantageously carried out before sandblasting—by burning at high temperature (pyrolysis).

A nanoceramic coating (e.g. based on titanium or zirconium) can first be applied to the correspondingly pre-cleaned metallic surface. Nanoceramic coatings are a further development of the well-known phosphatings. Advantages of a nanoceramic coating compared to phosphating are in particular:

Minimization of environmental impact,
phosphate-free process, and
more cost-effective process overall.

In this respect, the nanoceramic coating is a special pretreatment layer which can be regarded as a lower layer with respect to the first, inner layer and/or the second, outer layer. However, other layers as lower layers are also conceivable.

With regard to the invention or the embodiment examples described, the following can be noted:

- Good running-in behavior of the second, outer layer enables small gaps between the rotor screws and the compressor housing and thus more efficient compression.
- At the same time, very good corrosion protection is ensured by the first, inner layer, thus extending the service life of the components coated in this way.
- Running in only takes place in the second, outer layer; the first, inner layer serves as corrosion protection. This allows the two requirements of corrosion protection and running-in behavior (specifically separated from each other) to be optimized.
- PEEK is suitable for use in food contact environments (FDA compliant). The different particles are also suitable for foodstuffs.
- PEEK is environmentally friendly: PEEK dispersions are mostly water-based and have very low levels of volatile organic compounds (VOC). The application of the different layers does not pose any health risks and, in particular, does not cause cancer.
- It is very resistant to chemicals, which is of particular importance when gases other than air are to be compressed or when the intake air may be contaminated.
- The properties of the coating remain unchanged in contact with water, moisture and steam. Compared to other fluoropolymer coatings, PEEK in particular has very low water absorption, i.e. the risk of swelling of the coating is significantly reduced. This aspect appears to be particularly advantageous for screw compressors operating on the principle of minimum-quantity water injection.
- The operating behavior of the screw compressor is very smooth (the second, outer layer ensures good running-in behavior; even with constant friction contact, there is no undesired "pressing" of the rotor screws against each other).
- In addition, the second, outer layer, which defines the outermost layer in particular, shows very little adhesion, so that no dirt adheres which could lead to jamming between the rotor screws or between the rotor screws and the compressor housing.

In addition, the multilayer coating proposed here has a high temperature resistance as well as good resistance to temperature changes.

Finally, fluoropolymer-free coatings are required in some areas (e.g. in the tobacco industry). Some of these particles can be used to create fluoropolymer-free coatings.

The invention is explained in more detail below, also with regard to further features and advantages, on the basis of the description of embodiment examples and with reference to the enclosed drawings, wherein:

FIG. 7 shows a schematic embodiment of the multilayer coating of a rotor screw before running in;

FIG. 8 shows a schematic embodiment of the multilayer coating of a rotor screw after running in;

Figure 9:
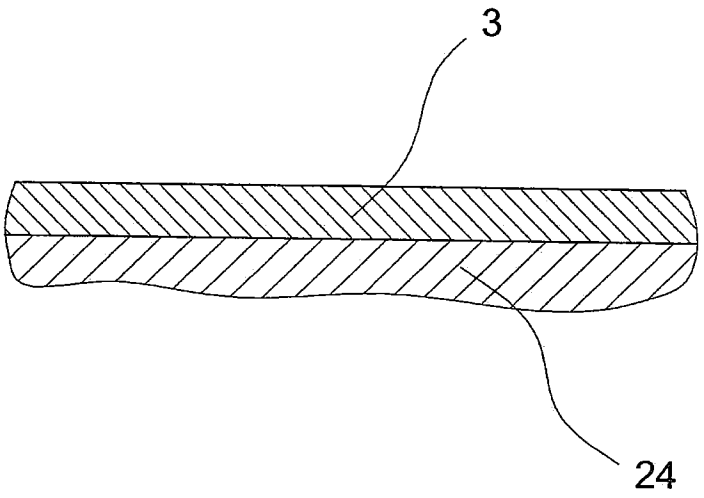
Figure 10:
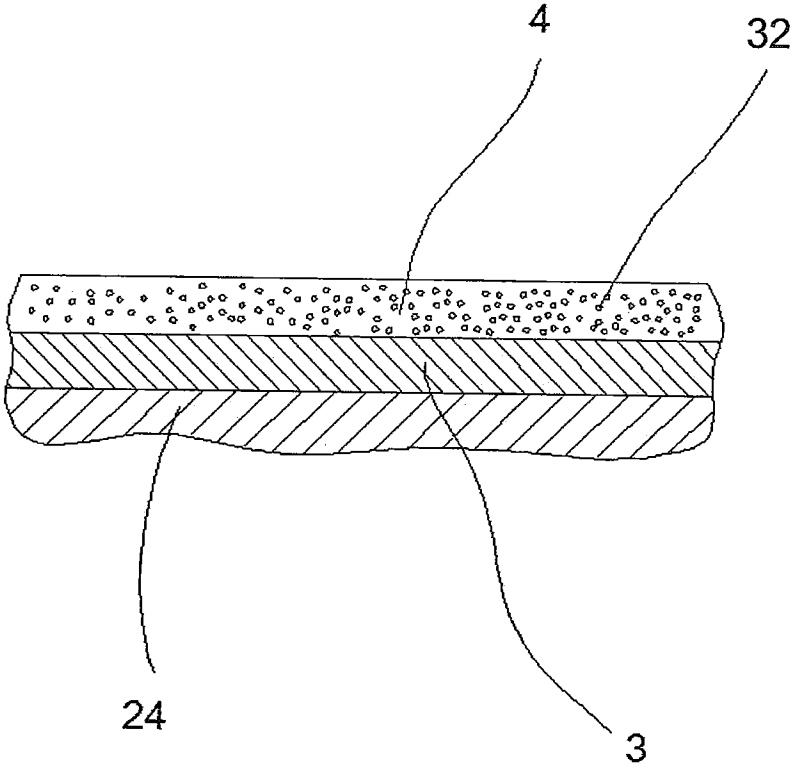
Figure 11:
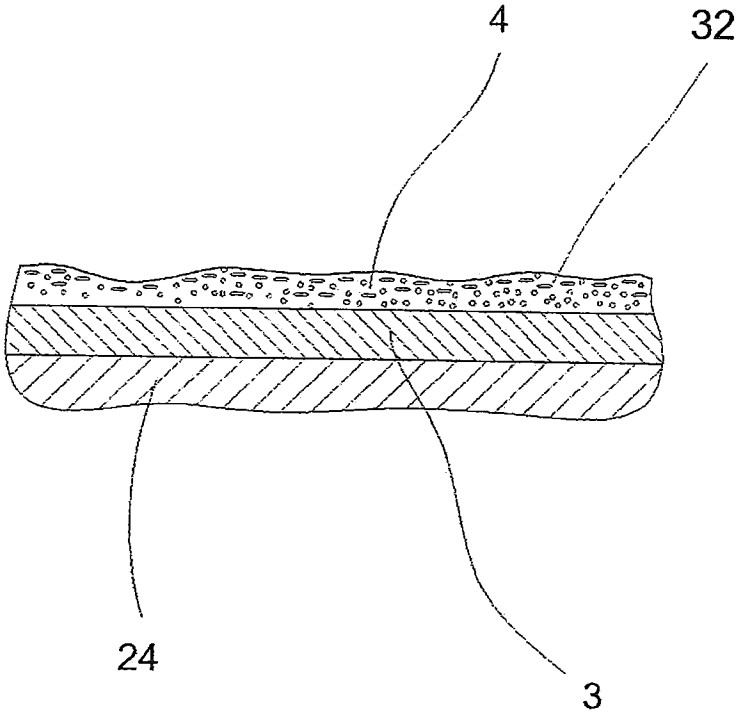
Figure 12:
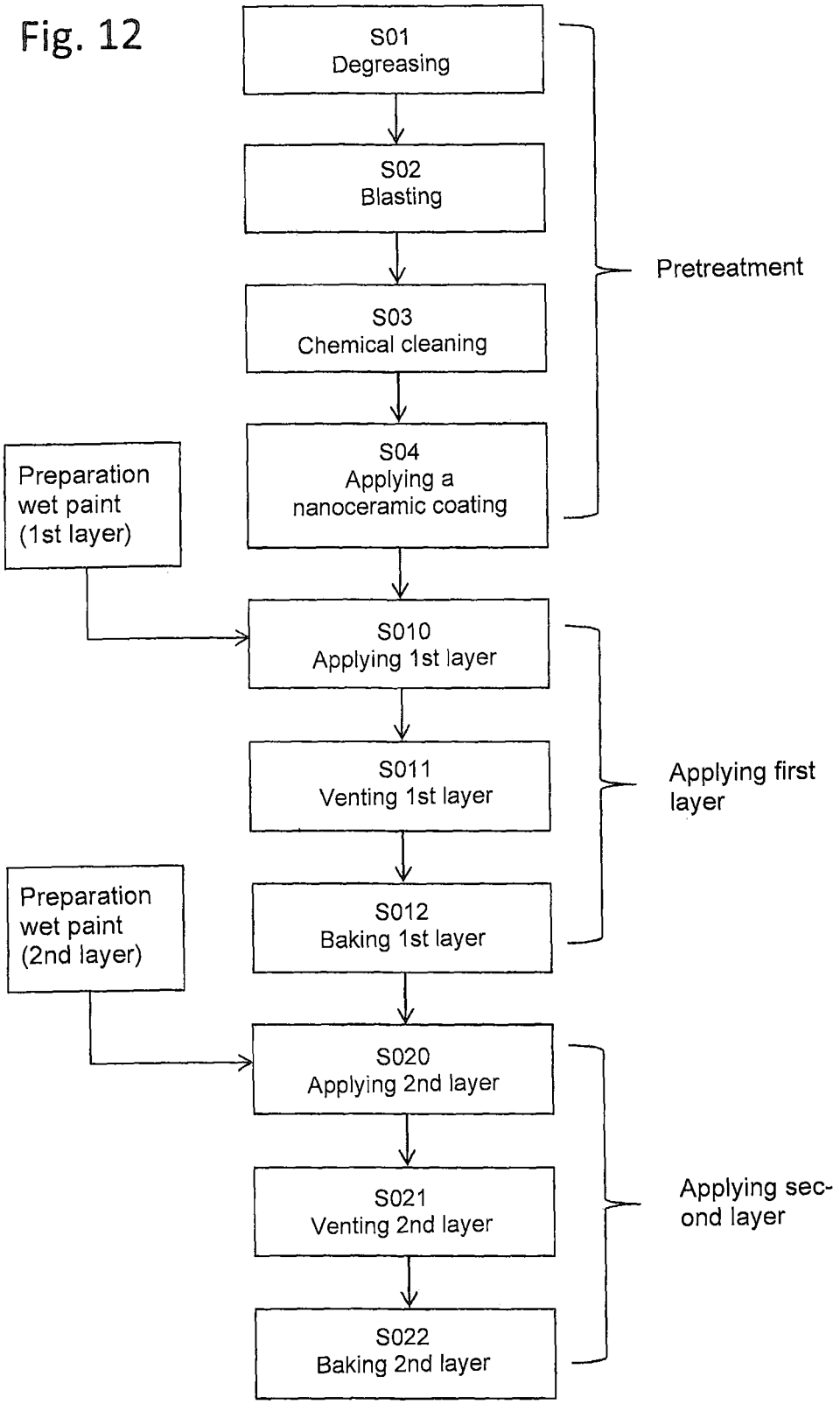

FIG. 9 schematically shows a merely single-layer coating of a section of a rotor screw;

FIG. 10 shows an alternative embodiment of a multilayer coating of a rotor screw before running in;

FIG. 11 shows the embodiment of the multilayer coating of a rotor screw according to FIG. 10 after running in;

FIG. 12 shows a sequence of a preferred embodiment example of the coating process in accordance with the invention.

Figure 1:
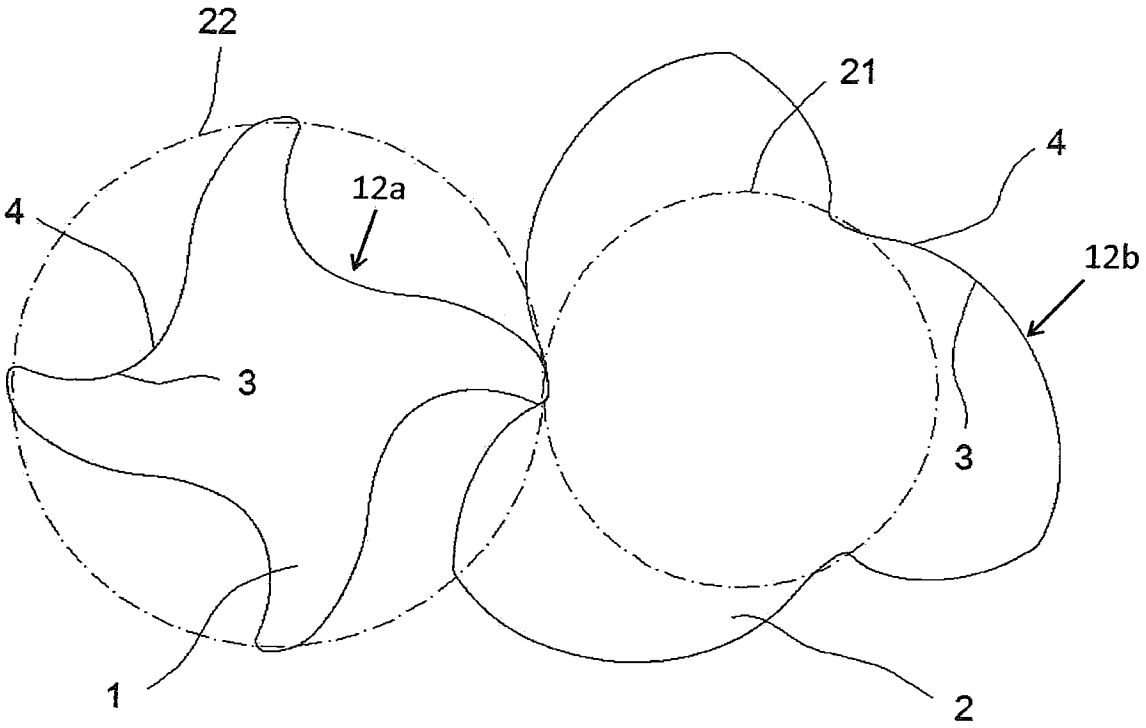
FIG. 1 shows a transverse section of a pair of rotor screws according to the invention.

FIG. 1 shows a transverse section of a pair of rotor screws according to the invention, comprising a rotor screw 1 designed as a secondary rotor and a rotor screw 2 designed as a main rotor. It is shown only purely schematically that a profiled surface 12*a*, 12*b* of rotor screw 1, 2 is coated in each case with first, inner layer 3 and second, outer layer 4. The rotor screws 1, 2 mesh with each other, i.e. they mesh with their teeth. The pitch circles already mentioned are marked with the reference symbol 22 for the rotor screw 1 designed as a secondary rotor and 21 for the rotor screw 2 designed as a main rotor.

Figure 2:
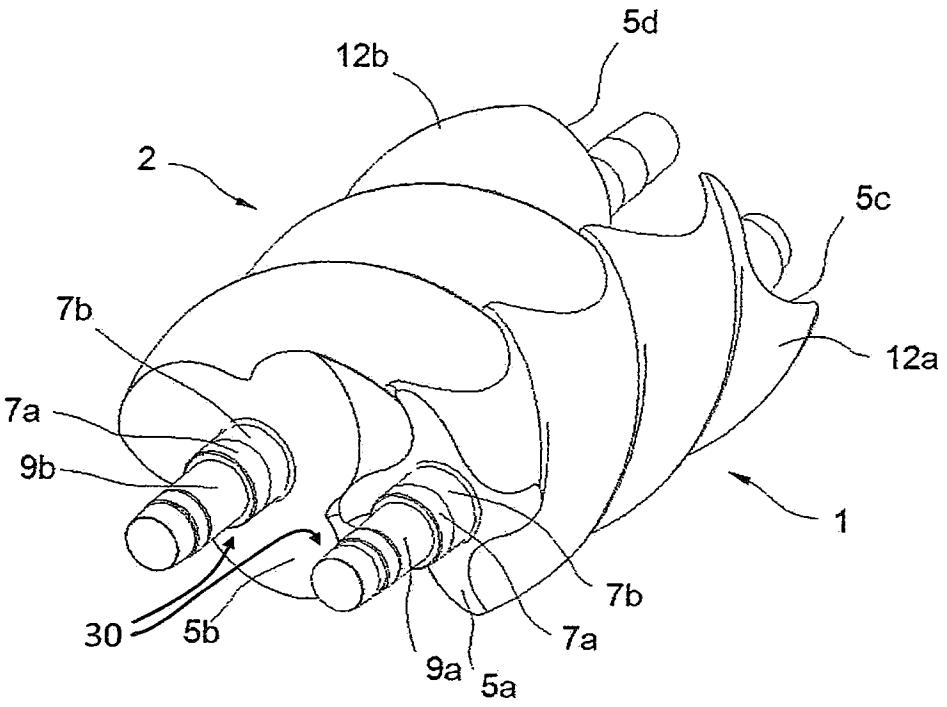
FIG. 2 shows two interlocked rotor screws in perspective view.

FIG. 2 shows the meshed rotor screws 1, 2 in perspective view. Both rotor screws 1, 2 with the already mentioned profiled surfaces 12*a*, 12*b* engage into each other or are meshed or screwed with each other. The profiled surfaces 12*a*, 12*b* are delimited perpendicularly to the respective rotor screw rotary axis by end faces 5*a*, 5*b*, 5*c*, 5*d* at the ends, wherein the end face 5*a* designates a pressure-side end face of the rotor screw 1 designed as a secondary rotor and the end face 5*c* designates a suction-side end face. In the case of the rotor screw 2 designed as the main rotor, the pressure-side end face is marked with the reference symbol 5*b* and the suction-side end face with the reference symbol 5*d*.

Protruding axially over the end faces 5*a*, 5*b*, 5*c*, 5*d* are protruding shaft ends 30 which each form a shaft 16 in pairs for a rotor screw 1, 2. At the shaft ends 30 a rotor-side seal seat 7*b* for an air seal, a rotor-side seal seat 7*a* for an oil seal and a rotor-side bearing seat 9*a*, 9*b* are formed. The rotor-side seal seat 7*b* is designed for an air seal adjacent to the end faces 5*a*, 5*b*, 5*c*, 5*d*, whereas the rotor-side bearing seat 9*a*, 9*b* is provided more towards the distal end of the shaft end 30. Between the rotor-side bearing seat 9*a*, 9*b* and the rotor-side seal seat for an air seal 7*b*, the already mentioned rotor-side seal seat 7*a* for an oil seal is provided.

Figure 3:
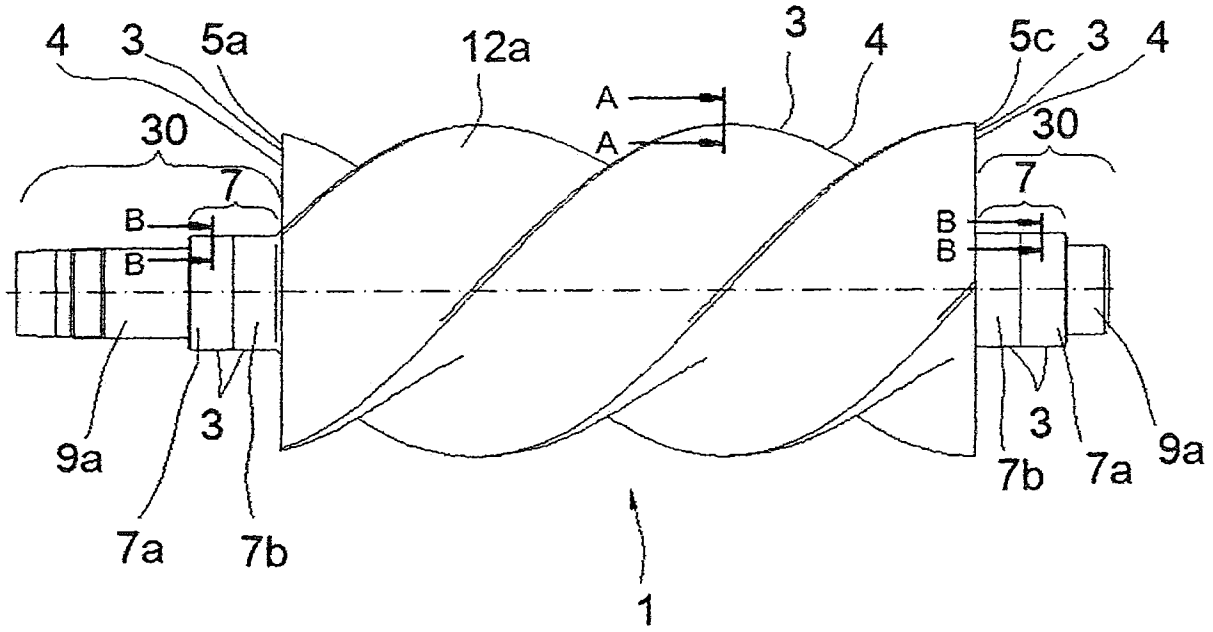
FIG. 3 shows an embodiment example of a rotor screw according to the invention, which here is specifically designed as a secondary rotor.

FIG. 3 shows an embodiment example of a rotor screw 1 designed as a secondary rotor, as already described in FIG. 2. Here too, the profiled surface 12*a* is coated with a first, inner layer 3 and a second, outer layer 4. The two end faces 5*a*, 5*c* are also coated with a first, inner layer 3 and a second, outer layer 4. The shaft ends, on the other hand, are only coated with a first, inner layer 3 between the end faces 5*a*, 5*c* and the bearing seats 9*a* (leaving out a second, outer layer 4), wherein the bearing seats 9*a*, however, are free, i.e.

without a coating corresponding to the first, inner layer 3, i.e. without a coating with a thermoplastic synthetic material.

Figure 4:
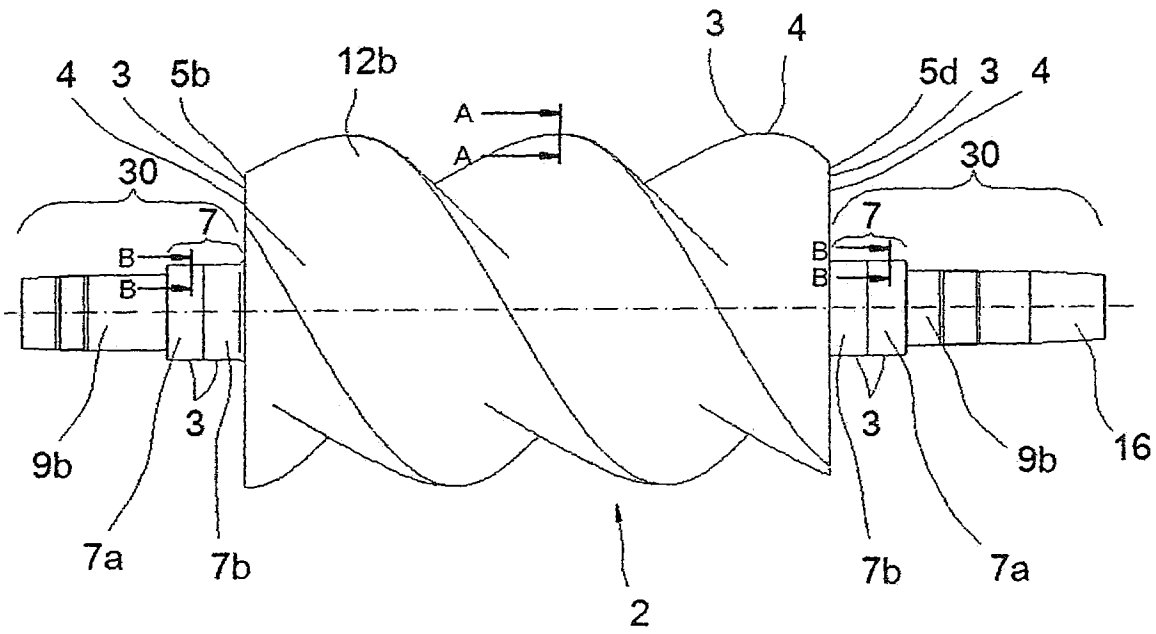
FIG. 4 shows an embodiment example of a rotor screw according to the invention, which here is specifically designed as a main rotor.

FIG. 4 shows an embodiment example of a rotor screw 2 designed as the main rotor, as already described by reference to FIG. 2. Here too, the profiled surface 12*b* is coated with a first, inner layer 3 and a second, outer layer 4. The two end faces 5*b*, 5*d* are also coated with a first, inner layer 3 and a second, outer layer 4. The shaft ends, on the other hand, are only coated with a first, inner layer 3 between the end faces 5*b*, 5*d* and the bearing seats 9*b* (leaving out a second, outer layer 4), wherein the bearing seats 9*a*, however, are free, i.e. without a coating corresponding to the first, inner layer 3, i.e. without a coating with a thermoplastic synthetic material.

Figure 5:
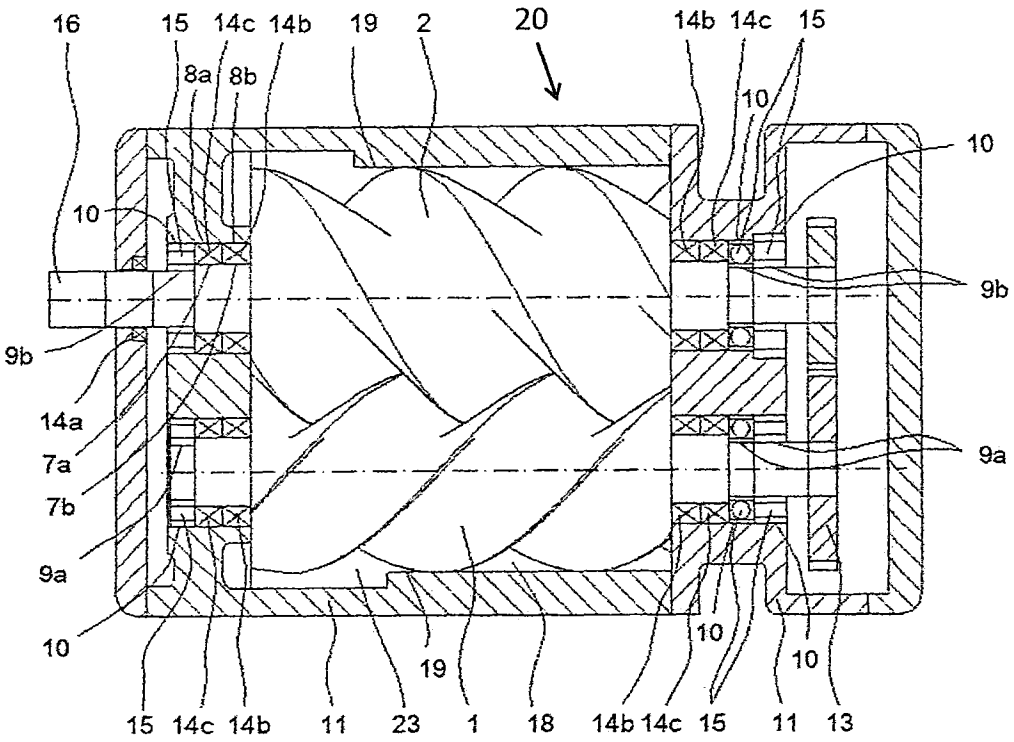
FIG. 5 shows a schematic cross-sectional view of a screw compressor.

FIG. 5 shows a schematic cross-sectional view of a screw compressor 20 with a compressor housing 11 and, mounted therein, two rotor screws 1, 2 which are meshed in pairs, namely a rotor screw 2 which is designed as a main rotor and a rotor screw 1 which is designed as a secondary rotor 1. The rotor screws 1, 2 are each mounted rotatably via suitable bearings 15 in a compression space 18 defined by a rotor bore 19 in the compressor housing 11 in a housing-side bearing seat 10. Seals 14*b* and 14*c*, which are each accommodated in a sealing seat 8*a* on the housing side for the oil seal and in a sealing seat 8*b* on the housing side for the air seal, prevent on the one hand the escape of compressed air from the compression space 18 and on the other hand the penetration of oil into the compression space 18. The compression space 18 in the compressor housing 11 is laterally limited by a rotor bore 18, which has two partial bores adapted to the diameters of the rotor screws 1, 2. At the end face, the compression space is limited by a pressure-side housing end face 6*a* and a suction-side housing end face 6*b*. Preferably, the pressure-side housing end face 6*a*, the suction-side housing end face 6*b* and the rotor bore 18 are also provided with the multilayer coating in accordance with the invention comprising a first, inner layer 3 and a second, outer layer 4.

Via a synchronous gear 13 the rotor screws 1, 2 are fixed in their rotary position against each other and their profiled surfaces 12*a*, 12*b*, especially their respective rotor flanks are kept at a distance. A drive power can be applied to the shaft 16 of the rotor screw 2 designed as the main rotor, for example by means of a motor (not shown) via a coupling (not shown). A suction area 23 of the screw compressor can be seen at the suction-side end of the rotor screws 1, 2 which are screwed together in pairs.

Figure 6:
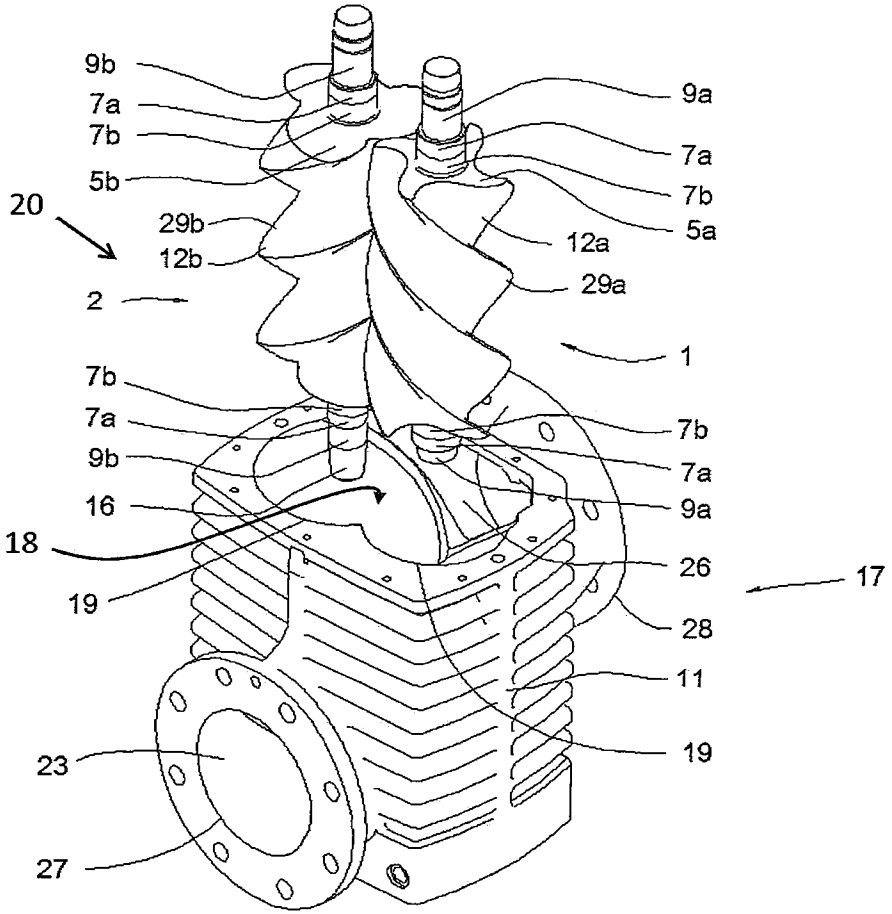
FIG. 6 shows an exploded view of a screw compressor.

FIG. 6 shows an exploded view of an embodiment of a screw compressor 20. The compressor housing 11 limits the compression space 18. Ambient air is sucked in via a suction port 27 and enters the suction area 23 of the screw compressor. After compression via the rotor screws 1, 2, the compressed air is ejected from the compressor housing 11 via a pressure port 28.

Figure 7:
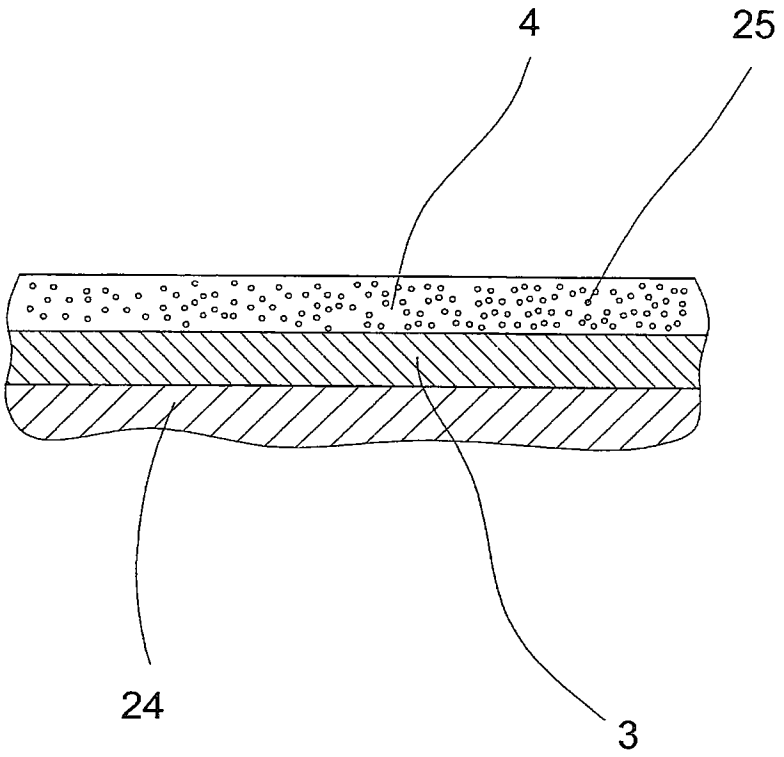

FIG. 7 illustrates the multilayer coating on the profiled surface 12*a* of rotor screw 1 along line A-A in FIG. 3. The first, inner layer 3 is first applied to a base body 24 of the rotor screw 1. On the first, inner layer 3—completely covering it—the second, outer layer 4 is applied. According to the invention, the second, outer layer 4 comprises particles 25 that support a running-in process, for example thin-walled hollow-glass microspheres. Alternatively or additionally, pores 32 can also be incorporated, which supports the plastic compressibility of the second, outer layer.

Figure 8:
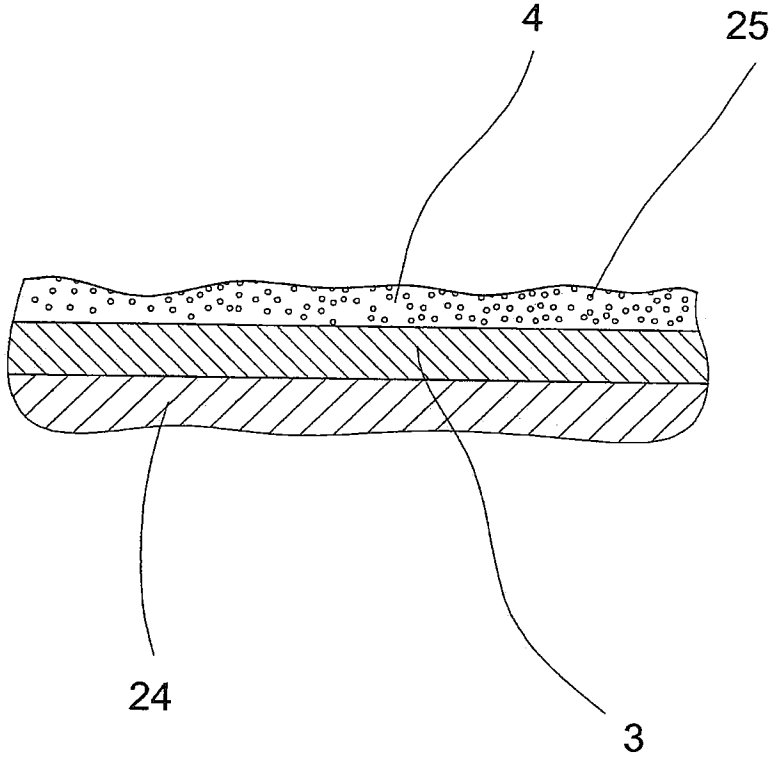

FIG. 8 shows the multilayer coating along line A-A on a rotor screw 1 according to FIG. 3 after the running-in process.

FIG. 9 shows an only integral coating on the shaft end 30 of the rotor screw 1, which is provided in the area of the rotor-side seal seat 7*a* for the oil seal and the rotor-side seal seat 7*b* for the air seal covering both seal seats 7*a*, 7*b*. In concrete terms, a section along line B-B is shown in FIG. 3. The first, inner layer here is arranged to cover the base body 24 and thus offers good and reliable corrosion protection.

FIG. 10 shows an alternative multilayer coating for a profiled surface 12*a*, 12*b* on a rotor screw 1, 2. Instead of the particles 25 described in FIG. 8, pores 32 are embedded in the second, outer layer, which were worked in, for example, by a foaming process before or during the application of the second, outer layer, for example in the wet paint process.

FIG. 11 shows the multilayer coating according to FIG. 10 after a running-in process. It can be seen that some areas of the layer have been removed or compressed. Also some of the pores 32 are removed with parts of the layer or compressed due to the absorbed counter pressure so that a plastic deformation of the second, outer layer 4 as running-in layer was achieved.

FIG. 12 schematically shows a flow chart for a possible design of the coating process. In a step sequence S01 to S04, the metallic surface to be coated is pretreated, for example the surface of a rotor screw to be coated. Step S01 involves degreasing the surface by burning it off at high temperature (pyrolysis). In the subsequent step S02, the surface is blasted, in particular sandblasted. After blasting, a step S03 follows, in which the surface is cleaned again chemically, for example using acetone. In step S04, a nanoceramic coating is then applied to the embodiment example described here.

This is followed by application of the first, inner layer 3, wherein the first, inner layer 3 is applied as a wet paint in the present example. However, alternative processes are also conceivable, for example dry application as powder coating. The wet paint for the first, inner layer is prepared beforehand, wherein the thermoplastic synthetic material in the form of PEEK is mixed in powder form in water with dispersing agent. A suspension is formed, which is applied to the pre-treated surface in step S10. In a subsequent step S11, the applied wet paint is dried or deaerated. In step S11, the rotor screw coated with the wet paint for the first coat is heated to approx. 120° C. for evaporation of the water. In one step S12, which can optionally also be omitted, the first layer is baked on. Baking takes place at temperatures of approx. 360° C. to 420° C., for example in a convection oven or inductively, until the PEEK has melted and a homogeneous layer has formed.

The second layer is applied in steps S20, S21, S22 which are analogous to steps S10, S11, S12. A wet lacquer is prepared again for this purpose, wherein appropriately—but not necessarily—the same thermoplastic synthetic material is used as for the application of the first layer—comprising or having PEEK as the thermoplastic synthetic material. For this purpose, the PEEK in powder form is mixed with the particles supporting the running-in process, for example the thin-walled glass microspheres, in particular made of borosilicate glass, together with water and dispersing agent. The second, outer layer 4 is applied in step S20 directly onto the first, inner layer 3, which has already been baked in the present example. However, it is also possible to leave step S12, i.e. the baking of the first layer, aside and baking the first, inner layer 3 and the second, outer layer 4 together. The application of the second, outer layer in step S20 is followed by a step of drying or ventilating of the second, outer layer. For this purpose, the rotor screw to be coated is heated up again to approx. 120° C. in step S21 or maintained at this temperature. After sufficient drying of the second, outer layer, the second, outer layer is baked in step S22 at temperatures of approx. 360° C. to 420° C., for example in a convection oven or in an inductive manner.

Optionally, a step S23 (not shown) may follow, which should preferably be avoided. In a step S23, the second, outer layer 4 could be regrinded in order to achieve the desired dimensioning by regrinding when the second, outer layer with oversize is formed. As already mentioned, however, it is preferred to achieve the desired dimensioning of the layer structure with the methods shown by reference to FIG. 12.

LIST OF REFERENCE SYMBOLS

1, 2 Rotor screw
3 First, inner layer
4 Second, outer layer
5*a*, 5*b*, 5*c*, 5*d* End faces
6*a* Pressure-side housing end face
6*b* Suction-side housing end face
7*a* Rotor-side seal seat for an air seal
7*b* Rotor-side seal seat for an oil seal
8*a* Housing-side seal seat for an oil seal
8*b* Housing-side seal seat for an air seal
9*a*, 9*b* Rotor-side bearing seat
10 Housing-side bearing seat
11 Compressor housing
12*a*, 12*b* Profile area
13 Synchronous gear
14*b* Seal
14*c* Seal
15 Bearings
16 Shaft
18 Compression space
19 Rotor bore
20 Screw compressor
21 Pitch circle (main rotor)
22 Pitch circle (secondary rotor)
23 Suction area
24 Base body
25 Particles
27 Suction port
28 Pressure port
30 Protruding shaft ends
32 Pores

The invention claimed is:

1. A screw compressor comprising:
a compressor housing;
two rotor screws mounted axially parallel in the compressor housing, the two rotor screws meshing with each other in a compression space and synchronized with each other in their rotational movement; and
a drive in communication with the two rotor screws to rotate the rotor screws;
wherein each of the rotor screws comprises a single-part or multi-part base body with two end faces and a profiled surface extending therebetween and shaft ends projecting beyond the end faces, each of the shaft ends comprising a bearing seat and seal seats between the bearing seat and the end face;
wherein:
each profiled surface is coated with a first layer and the first layer is coated with a second layer, wherein the first layer and the second layer both comprise a thermoplastic synthetic material; and
each of the seal seats is coated with only the first layer; and wherein particles or pores supporting a running-in process are embedded in the second layer and the thermoplastic synthetic material defines a matrix for receiving the particles or for forming the pores, respectively.

2. The screw compressor of claim 1, wherein the thermoplastic synthetic material for forming the first layer and the second layer is a semi-crystalline high-performance thermoplastic synthetic material.

3. The screw compressor of claim 1, wherein the first layer forms a substantially homogeneous coating and a corrosion protection layer.

4. The screw compressor of claim 1, wherein:
the first layer comprises a first layer thickness of 5 μm to 50 μm; and
the second layer comprises a second layer thickness of 10 μm to 120 μm.

5. The screw compressor of claim 1, wherein the screw compressor comprises an oil-free screw compressor.

6. A method for applying a multilayer coating to surfaces of a rotor screw of a screw compressor, the method comprising:
applying a first layer of a first thermoplastic synthetic material to a profiled surface of the rotor screw, the rotor screw comprising a single-part or multi-part base body with two end faces and the profiled surface extending therebetween and shaft ends projecting beyond the end faces, each of the shaft ends comprising a bearing seat and seal seats between the bearing seat and the end face;
coating the first layer of synthetic material on the profile surface with a second layer of a second thermoplastic synthetic material;
applying only the first layer of the first thermoplastic synthetic material to each of the seal seats of the rotor screw;
wherein particles or pores supporting a running-in process are embedded in the second layer and the second thermoplastic synthetic material defines a matrix for receiving the particles or for forming the pores, respectively.

7. The method of claim 6, wherein the method further comprises applying a zirconium-based nanoceramic layer to the profiled surface and each of the seal seats before applying the first layer.

8. The method of claim 6, wherein the method further comprises pretreating the profiled surface and each of the seal seats by degreasing the profiled surface and each of the seal seats, roughening the profiled surface and each of the seal seats, cleaning the profiled surface and each of the seal seats, or combinations thereof.

9. The method of claim 6, wherein the method further comprises baking at least one of the first layer and the second layer to form a homogenous layer.

10. The method of claim 9, wherein baking the at least one of the first layer and the second layer comprise baking at least one of the first and second layer at a temperature of from about 360° C. to about 420° C.

11. A screw compressor comprising:
a compressor housing;
two rotor screws mounted axially parallel in the compressor housing, the two rotor screws meshing with each other in a compression space and synchronized with each other in their rotational movement; and
a drive in communication with the two rotor screws to rotate the rotor screws; wherein:
each profiled surface is coated with a first layer and the first layer is coated with a second layer, wherein the first layer and the second layer both comprise a thermoplastic synthetic material; and each of shaft ends comprising a bearing seat, each of the bearing seats is uncoated;

wherein particles or pores supporting a running-in process are embedded in the second layer and the thermoplastic synthetic material defines a matrix for receiving the particles or for forming the pores, respectively.

12. The screw compressor of claim 11, wherein the thermoplastic synthetic material for forming the first layer and the second layer is a semi-crystalline high-performance thermoplastic synthetic material.

13. The screw compressor of claim 11, wherein the first layer forms a substantially homogeneous coating and a corrosion protection layer.

14. The screw compressor of claim 11, wherein:

the first layer comprises a first layer thickness of 5 μm to 50 μm; and the second layer comprises a second layer thickness of 10 μm to 120 μm.

15. The screw compressor of claim 11, wherein the screw compressor comprises an oil-free screw compressor.

16. A method for applying a multilayer coating to surfaces of a rotor screw of a screw compressor, the method comprising:

applying a first layer of a first thermoplastic synthetic material to a profiled surface of the rotor screw, the rotor screw comprising a single-part or multi-part base body with two end faces and the profiled surface extending therebetween and shaft ends projecting beyond the end faces, each of the shaft ends comprising a bearing seat and seal seats between the bearing seat and the end face;

coating the first layer of synthetic material on the profile surface with a second layer of a second thermoplastic synthetic material; and maintaining each of the bearing seats uncoated by either the first layer or the second layer;

wherein particles or pores supporting a running-in process are embedded in the second layer and the second thermoplastic synthetic material defines a matrix for receiving the particles or for forming the pores, respectively.

17. The method of claim 16, wherein the method further comprises applying a zirconium-based nanoceramic layer to the profiled surface and each of the seal seats before applying the first layer.

18. The method of claim 16, wherein the method further comprises pretreating the profiled surface and each of the seal seats by degreasing the profiled surface and each of the seal seats, roughening the profiled surface and each of the seal seats, cleaning the profiled surface and each of the seal seats, or combinations thereof.

19. The method of claim 16, wherein the method further comprises baking at least one of the first layer and the second layer to form a homogenous layer.

20. The method of claim 19, wherein baking the at least one of the first layer and the second layer comprise baking at least one of the first and second layer at a temperature of from about 360ºC to about 420° C.

* * * * *